US008844062B2

(12) United States Patent
Tirard

(10) Patent No.: US 8,844,062 B2
(45) Date of Patent: Sep. 30, 2014

(54) GARMENT FOR BALLISTIC PROTECTION AND CARRYING EQUIPMENT

(75) Inventor: Franck Tirard, Paris (FR)

(73) Assignee: Sagem Defense Securite, Boulogne-Billancourt (FR)

( * ) Notice: Subject to any disclaimer, the term of this patent is extended or adjusted under 35 U.S.C. 154(b) by 0 days.

(21) Appl. No.: 14/123,957

(22) PCT Filed: Jun. 7, 2012

(86) PCT No.: PCT/EP2012/060802

§ 371 (c)(1),
(2), (4) Date: Dec. 4, 2013

(87) PCT Pub. No.: WO2012/168366

PCT Pub. Date: Dec. 13, 2012

(65) Prior Publication Data

US 2014/0101810 A1 Apr. 17, 2014

(30) Foreign Application Priority Data

Jun. 8, 2011 (FR) ..... 11 54991

(51) Int. Cl.

| | |
|---|---|
| ***F41H 1/02*** | (2006.01) |
| ***A41D 1/04*** | (2006.01) |
| ***A45F 3/14*** | (2006.01) |
| ***A45F 5/02*** | (2006.01) |
| ***A45F 3/10*** | (2006.01) |
| *A45F 3/00* | (2006.01) |

(52) U.S. Cl.

CPC .. *F41H 1/02* (2013.01); *A45F 3/14* (2013.01); *A45F 5/02* (2013.01); *A45F 3/10* (2013.01); *A45F 2003/146* (2013.01); *A45F 3/00* (2013.01)

USPC ..... 2/2.5; 2/102

(58) Field of Classification Search

USPC ..... 2/2.5, 102, 69, 108, 463, 467, 94, 96; 224/663, 660, 628, 576, 582, 583; 89/36.05

See application file for complete search history.

(56) References Cited

U.S. PATENT DOCUMENTS

| | | | | |
|---|---|---|---|---|
| 4,608,987 | A * | 9/1986 | Mills | 600/389 |
| 7,937,780 | B2 * | 5/2011 | Matic et al. | 2/465 |
| 8,528,112 | B2 * | 9/2013 | Blauer et al. | 2/2.5 |
| 2002/0120973 | A1 * | 9/2002 | D'Annunzio | 2/92 |
| 2003/0188631 | A1 * | 10/2003 | Park | 89/36.02 |
| 2005/0005343 | A1 * | 1/2005 | Johnson | 2/102 |

(Continued)

FOREIGN PATENT DOCUMENTS

| | | | |
|---|---|---|---|
| EP | 2 267 398 | A1 | 12/2010 |
| WO | WO 00/48480 | * | 8/2000 |
| WO | WO 2007/063518 | A2 | 6/2007 |

*Primary Examiner* — Amy Vanatta

(74) *Attorney, Agent, or Firm* — Blakely Sokoloff Taylor & Zafman

(57) ABSTRACT

The invention relates to a garment for ballistic protection and carrying equipment, including: a carrying harness including a back portion suitable for covering the back of a user, the back portion including a cover for accommodating a back-protecting pack and straps suitable for being placed over the shoulders of the user in order to hang the harness from the shoulders; and two abdominal portions suitable for covering the torso of the user, each abdominal portion being designed to be removably attached onto a respective suspender of the carrying harness, the abdominal portions including a closing device for connecting the abdominal portions together in order to close the vest.

8 Claims, 3 Drawing Sheets

(56) References Cited

U.S. PATENT DOCUMENTS

Figure 1:
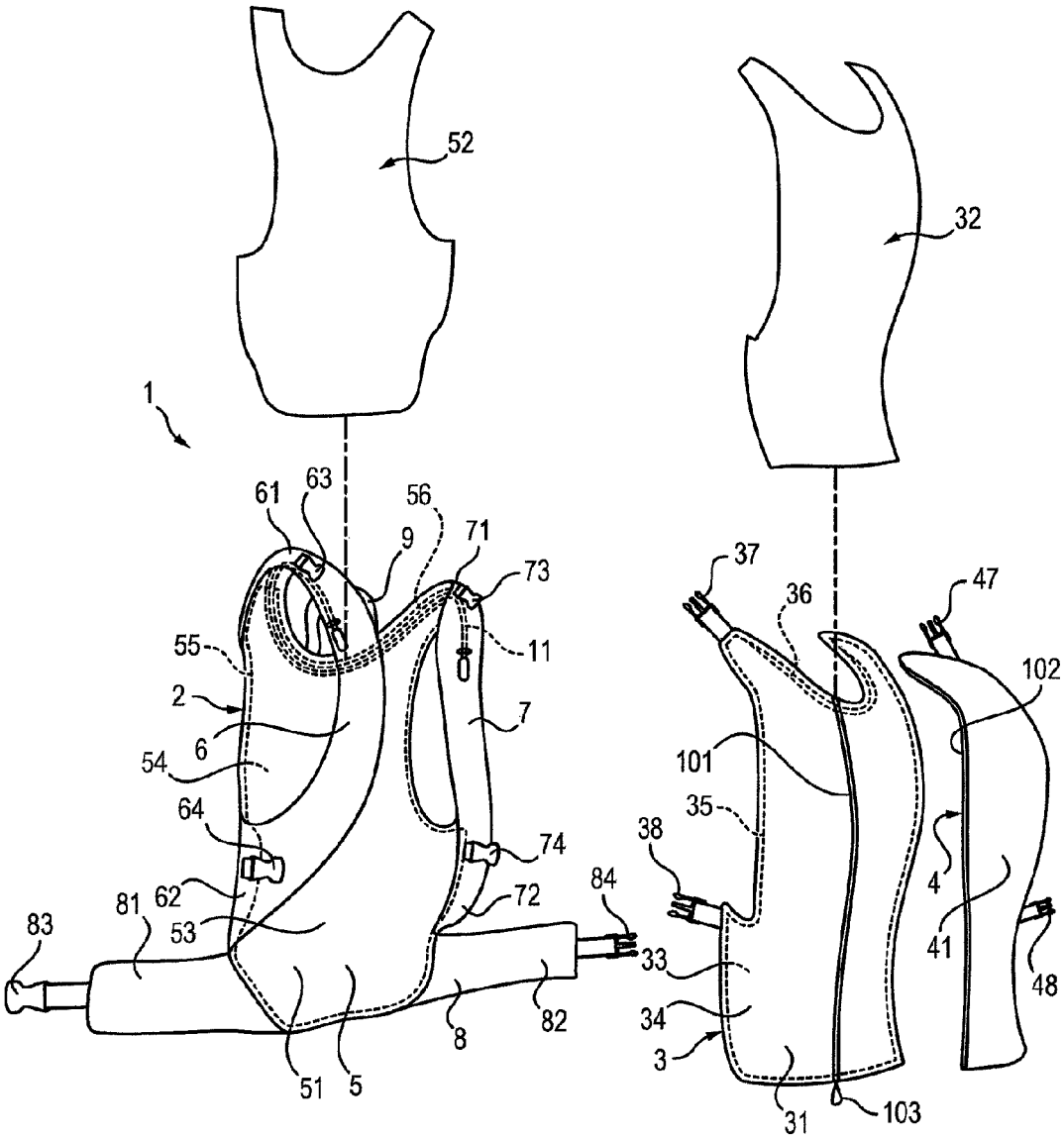

| | | | | |
|---|---|---|---|---|
| 2007/0079415 | A1* | 4/2007 | Carlson | 2/2.5 |
| 2008/0120819 | A1 | 5/2008 | Rene et al. | |
| 2008/0216219 | A1* | 9/2008 | Desnoyers | 2/463 |
| 2009/0282595 | A1* | 11/2009 | Branson et al. | 2/2.5 |
| 2010/0088799 | A1 | 4/2010 | Carter | |
| 2012/0024924 | A1* | 2/2012 | Hexels | 224/576 |
| 2012/0144551 | A1* | 6/2012 | Guldalian | 2/102 |
| 2012/0167288 | A1* | 7/2012 | Chen et al. | 2/458 |
| 2013/0312150 | A1* | 11/2013 | Klein | 2/2.5 |

* cited by examiner

GARMENT FOR BALLISTIC PROTECTION AND CARRYING EQUIPMENT

FIELD OF THE INVENTION

The invention relates to a garment for ballistic protection and carrying equipment.

PRIOR ART

Combatants on foot generally have to put on several items of equipment for carrying and protection, including:

- a ballistic protection vest mainly designed to protect the thorax, abdomen and back from weapons fire, the protective vest including ballistic protection packs comprising superposition of layers of material adapted to absorb impacts,
- a tactical vest mainly designed to transport materiel which must be close at hand for the combatant, such as munitions and electronic equipment (radio communication set, computer unit, man-machine interface, a screen, and batteries), the tactical vest including a set of pockets for receiving the various equipment,
- a backpack designed to transport the rations of the combatant and the equipment as a function of his mission.

Each item of equipment is currently designed independently and is generally not optimised to take into account the bulk and distribution of weight of other equipment.

The consequence of this in use is that the superposition of various equipment can present difficulties. For example, dressing and undressing can prove complicated, which is disadvantage in the event of emergency. Also superposition of equipment can hamper the movements of the user.

Also, the weights of individual equipment are added and constitute a considerable load on the combatant.

Since ballistic protection and tactical vests essentially rest on the shoulders of the combatant, this can cause him back problems due to the considerable weight of this equipment.

Finally, it is not possible to easily and rapidly adapt the equipment worn to the particular features of the mission of the combatant.

SUMMARY OF THE INVENTION

An aim of the invention is to propose a single garment which can ensure ballistic protection of the user and carry equipment as a function of needs.

This problem is resolved within the scope of the present invention by a garment for ballistic protection and for carrying equipment, comprising:

- a carrying harness comprising a dorsal part suitable for covering the back of a user, the dorsal part comprising a cover to receive a ballistic pack for protection of the back, and straps adapted to encircle the shoulders of the user to suspend the harness on the shoulders, and
- two abdominal parts suitable for covering the torso of the user, each abdominal part being adapted to be fixed detachably on a respective strap of the carrying harness, the abdominal parts comprising a closing device for connecting the abdominal parts together to close the garment.

The carrying harness constitutes autonomous equipment (that is, it is adapted to be held by itself on the user). However, the two abdominal parts are fixed on the carrying harness so as to form a vest. In this way, the abdominal parts can be easily detached and replaced as a function of the mission of the user.

Accordingly, the carrying harness fulfils a protective function of the user, but can also be used for carrying equipment, especially because of the abdominal parts.

The entire load is transferred to the carrying harness.

The garment can also have the following characteristics:

- the carrying harness comprises a belt connected to the dorsal part and adapted to encircle the waist of the user to transfer some of the weight exerted on the carrying harness to the hips of the user,
- at least one of the abdominal parts comprises a cover to receive a torso protection pack, the abdominal parts being suitable for covering the torso by overlapping,
- in particular, one of the abdominal parts covers the other abdominal part over a covering area representing substantially half of the abdominal part,
- once the garment is closed, the torso protection pack and the back protection pack are positioned relative to each other such that they overlap in areas of the shoulders and in areas of the flanks of the user,
- the carrying harness comprises an electrical connection cable extending along the straps, passing over the shoulders of the user and the dorsal part and capable of connecting equipment positioned on one of the abdominal parts to equipment positioned on the other of the abdominal parts,
- the garment comprises a transport housing adapted to be connected detachably to the carrying harness by being positioned against the dorsal part, on an external wall of the cover,
- the abdominal parts comprise a set of pockets adapted to receive electronic equipment and/or munitions.

PRESENTATION OF DRAWINGS

Figure 2:
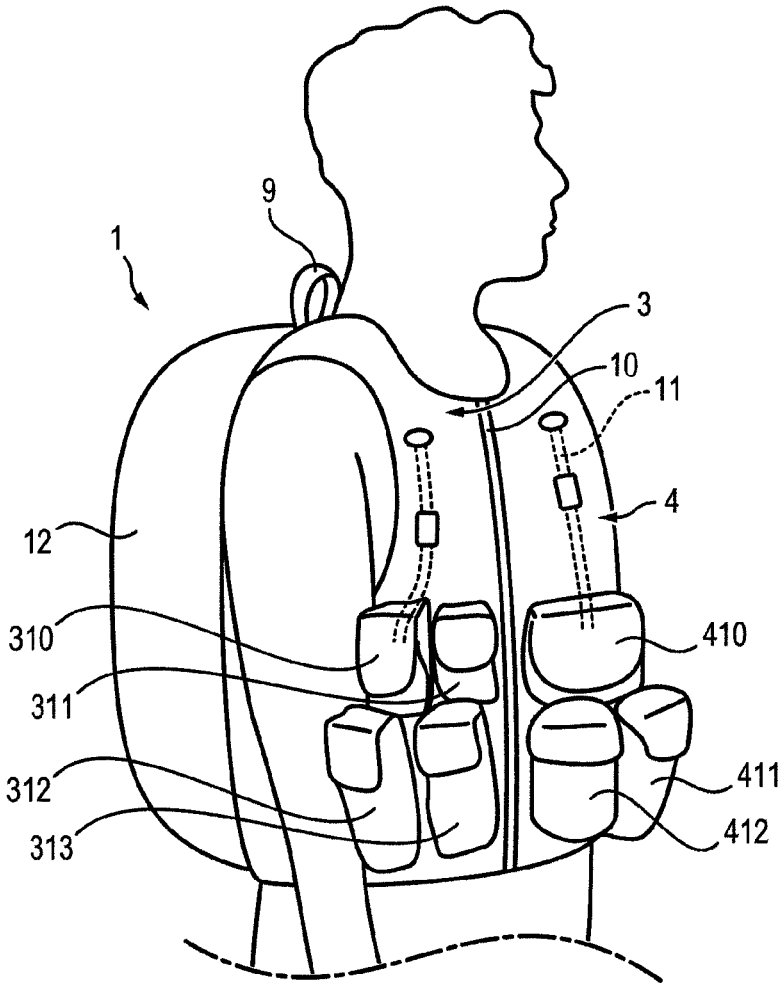
Figure 3:
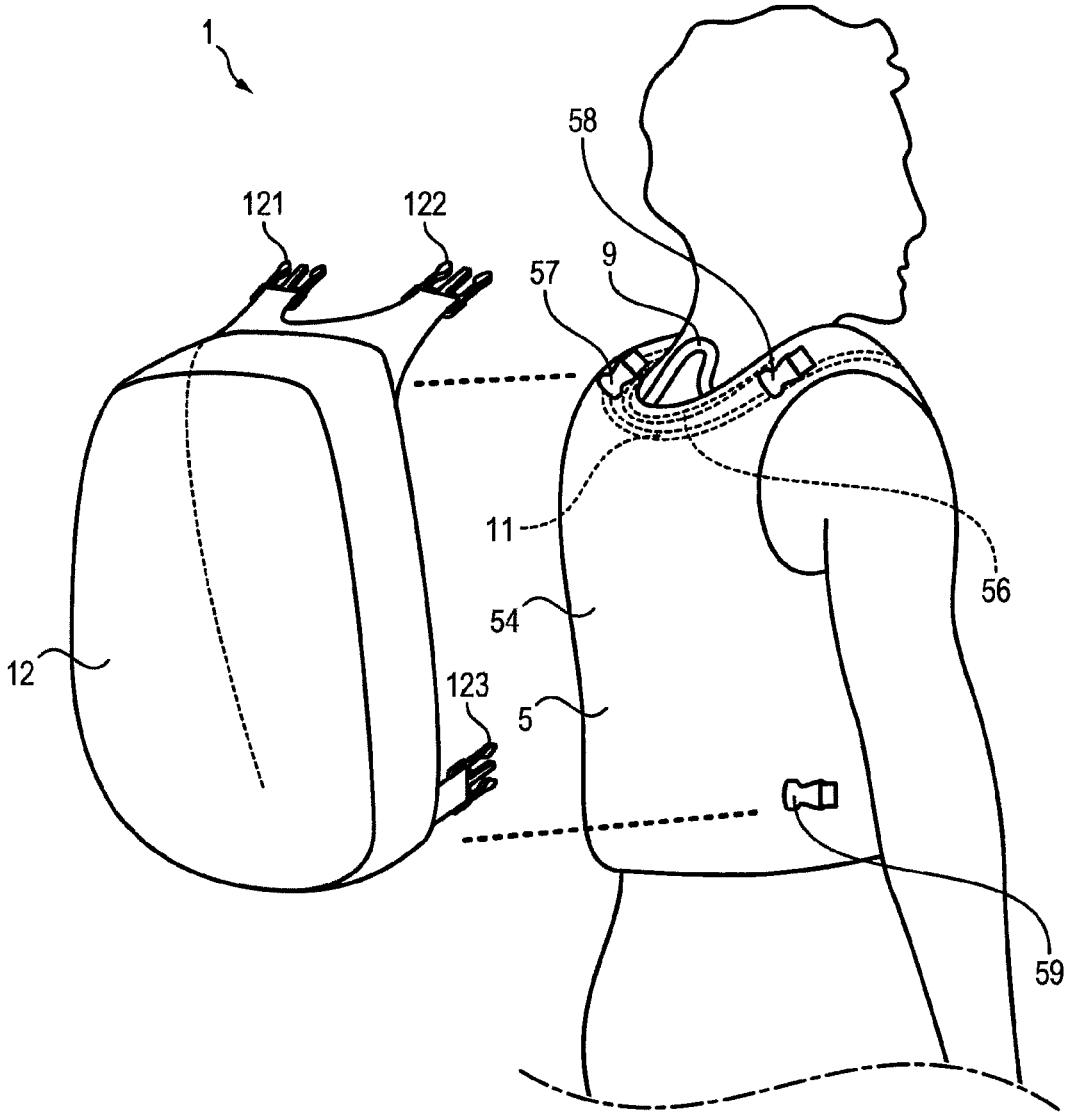

Other characteristics and advantages will emerge from the following description which is purely illustrative and non-limiting and must be considered in conjunction with the attached figures, in which:

FIG. 1 schematically illustrates a protective garment according to an embodiment of the invention, FIGS. 2 and 3 schematically illustrate a frontal and rear view of a user wearing the protective garment.

DETAILED DESCRIPTION

As is illustrated in FIG. 1, the illustrated protective garment 1 comprises a carrying harness 2 and two removable abdominal parts 3 and 4.

The carrying harness 2 comprises a dorsal part 5 (or backrest), a right strap 6, a left strap 7, an abdominal belt 8, as well as a transport handle 9.

The dorsal part 5 comprises a cover 51 and a ballistic pack 52 for protection of the back. The cover 51 has an internal wall 53 (that is, oriented to the back of the user) and an external wall 54 (that is, oriented to the outside) together forming a dorsal pocket 55, and an opening 56 by which the pack 52 for protection of the back can be inserted inside the dorsal pocket 55. The protection pack 52 generally comprises a multilayer complex constituted by a plurality of superposed layers designed to absorb the impacts of projectiles, such as fragments of explosive devices or bullets, or weapon fire, and optionally a tight protection pocket containing the complex to protect the complex from humidity and ultra-violet radiation.

The internal wall 53 and the external wall 54 are formed of flexible fabric. The external wall 54 which is designed to be in contact with the back of the user comprises a so-called fabric of "three-dimensional structure" to promote circulation of air across the fabric and ventilation of the back. The dorsal part 5 can include an inner reinforcing plate. Also, the dorsal part 5 can include shock-absorbing blocks between the reinforcing plate and the external wall 54, for example made of alveolar material.

Each strap 6, 7 is fixed permanently on the dorsal part 5, and comprises a first end 61, 71 connected to an upper are of the dorsal part 5 (or shoulder area) and a second end 62, 72 connected to a lower area of the dorsal part 5 (or hips area). The straps 6 and 7 are adapted to encircle the shoulders of the user to suspend the harness 2 on the shoulders while the garment is placed on the user.

Each strap 6, 7 comprises a first connection element 63, 73, near its first end 61, 71 and a second connection element 64, 74 near its second end 62, 72. The connection elements 63 and 64 of the first strap 6 are intended to enable the first abdominal part 3 to attach to the harness 2. The connection elements 73 and 74 of the second strap 7 are designed to enable the second abdominal part 4 to attach to the harness 2.

The abdominal belt 8 comprises a first portion 81 and a second portion 82 each having an end connected to a lower area of the dorsal part. At the level of its free end each portion 81, 82 comprises complementary connection elements 83, 84 for joining together the portions 81 and 82 of the belt. The belt 8 is designed to encircle the waist of the user to transfer some of the weight exerted on the carrying harness on the hips of the user and stabilise the garment on the user. Once the harness 2 is suspended on the shoulders of the user, the portions 81 and 82 are connected together to encircle the waist of the user. The portions 81 and 82 can comprise an adjustment device for adapting the belt to the morphology of the user.

The connection elements 83, 84 are for example complementary snap-locking buckles, wherein one of the buckles 84 is adapted to nest in the other buckle 83, enabling rapid attachment and detachment of the belt 8.

The handle 9 helps transport the harness 2 and the entire garment 1.

The first abdominal part 3 comprises a cover 31 and a pack 32 for ballistic protection of the torso. The cover 31 presents an internal wall 33 and an external wall 34 together forming a pouch 35, and an opening 36 via which the pack 32 for protection of the torso can be inserted inside the pouch 35. The first abdominal part 3 can also comprise one or more extra pockets (not shown) adapted to house one or more rigid protection plates.

The first abdominal part 3 also comprises two connection elements 37 and 38 capable of cooperating with the connection elements 63 and 64 of the first strap 6 to fix the first abdominal part 3 onto the harness 2. More precisely, each element 37, respectively 38, 47, 48, is adapted to fit each element 63 complementary, respectively 64, 73, 74, and be held in the complementary element 63, respectively 64, 73, 74 by snap-locking.

The second abdominal part 4 comprises a single wall 41 and does not take up a protection pack. The second abdominal part 4 also comprises two connection elements 47 and 48 capable of cooperating with the connection elements 73 and 74 of the second strap 7 to fix the second abdominal part 4 onto the harness 2.

The first abdominal part 3 and the second abdominal part 4 comprise a sliding closing device 10 for connecting together the abdominal parts 3 and 4 to close the garment 1 on the torso of the user. The closing device 10 comprises a first closure strip 101 fixed on the abdominal part 3, a second closure strip 102 fixed on the abdominal part 4, and a slider 103 capable of sliding on the strips for connecting the strips together.

The first closure strip 101 extends substantially along a median line of the first abdominal part 3, whereas the second closure strip extends along a border of the second abdominal part 4.

This arrangement of the closure strips 101, 102 produces a garment 1 which closes across the front like a vest, and provides just one ballistic torso protection pack for better comfort during use. In fact, when the garment 1 is closed, the pack 32 substantially covers the entire torso of the user. Also, the second abdominal part 4 covers the first abdominal part 3 over a covering area representing substantially half of the abdominal part 4.

Also, once the garment closed on the user, the ballistic protection packs 32 and 52 are positioned relative to each other such that they overlap in the area of the shoulders and in the areas of the flanks to ensure continuity of protection between the back and the torso.

As the abdominal parts 3 and 4 are removable, they can be replaced easily as a function of the mission the user is on.

Also, abdominal parts 3 and 4 different can be provided for left-handed users and right-handed users.

Also, the harness 2 comprises one or more cable(s) 11 for electrical connection, or a conduit adapted to receive such a cable, extending along each of the straps 6 and 7 and of the dorsal part 5 around the neck so as to be capable of attaching electrical equipment positioned on one of the abdominal parts 3 and 4 to electrical equipment positioned on the other of the abdominal parts 3 and 4. More precisely, the cable 11 extends inside the dorsal part 5 and inside the straps 6 and 7 as it bypasses the neck of the user.

As is illustrated in FIG. 2, the abdominal parts 3 and 4 comprise also a set of pockets respectively 310 to 313 and 410 to 412. The pockets 310 to 313 and 410 to 412 can be fixed detachably to the external walls 34 and 41 of the abdominal parts. These pockets 310 to 313 and 410 to 412 are adapted to contain materiel which has to be close at hand for the user when he is wearing such a garment, such as munitions and electronic equipment (radio communication set, computer unit, batteries, etc), normally stowed away in a separate tactical vest.

As is illustrated in FIG. 3, the garment 1 comprises a flexible or semi-rigid transport housing 12 adapted to be fixed detachably on the dorsal part 5 of the harness 2 against the external wall 54.

For this purpose, the dorsal part 5 comprises connection elements 57 to 59 and the housing 12 comprises complementary connection elements 121 to 123 capable of cooperating with the elements 57 to 59 to fix the housing 12 detachably on the harness 2. The connection elements 57 to 59 and 121 to 123 are for example snap-locking buckles which enable rapid attachment and detachment of the housing 12.

The housing 12 can for example constitute a compartment for transporting small materiel normally stowed away in a separate backpack such as a first-aid kit for example.

Because of the connection elements 57 to 59 and 121 to 123, the housing 12 can be replaced easily by another housing, as a function of the mission of the user.

The connection elements 57 to 59 and 121 to 123 also allow rapid dropping of the housing 12 in the event of emergency.

As the use of an additional backpack is not necessary, the passage of the cable electrical along the straps 6 and 7 of the harness 2 does not impair comfort of the user.

The belt 8 ensures transfer of some of the weight exerted on the carrying harness 2 on the hips of the user, and avoids overburdening the shoulders. This allows greater freedom of movement for the user and reduces back problems.

The invention claimed is:

1. A garment (1) for ballistic protection and carrying equipment comprising:

a carrying harness (2) comprising a dorsal part (5) suitable for covering the back of a user, the dorsal part (5) comprising a cover (51) to receive a protection pack (52) for the back, and straps (6, 7) adapted to encircle the shoulders of the user for suspending the harness (2) on the shoulders, and two abdominal parts (3, 4) suitable for covering the torso of the user, each abdominal part (3, 4) being adapted to be fixed detachably on a respective strap (6, 7) of the carrying harness (2), the abdominal parts (3, 4) comprising a closing device (10) for joining together the abdominal parts (3, 4) to close the garment, wherein the carrying harness (2) comprises an electrical connection cable (11) extending along the straps (6, 7), passing over the shoulders of the user and the dorsal part (5) and capable of attaching equipment positioned on one of the abdominal parts (3) to equipment positioned on the other of the abdominal parts (4).

2. The garment according to claim 1, wherein the carrying harness (2) comprises a belt (8) connected to the dorsal part (5) and adapted to encircle the waist of the user to transfer some of the weight exerted on the carrying harness (2) on the hips of the user.

3. The garment according to claim 1, wherein at least one of the abdominal parts (3, 4) comprises a cover (31) to receive a protection pack (32) for the torso, the abdominal parts (3, 4) being suitable for covering the torso by overlapping.

4. The garment according to claim 3, wherein one of the abdominal parts (4) covers the other abdominal part (3) on a covering area representing substantially half of the abdominal part (4).

5. The garment according to claim 3, wherein, once the garment is closed the protection pack (32) for the torso and the protection pack (52) for the back are positioned relative to each other such that they overlap in areas of the shoulders and in areas of the flanks of the user.

6. The garment according to claim 1, comprising a transport housing (12) adapted to be connected detachably to the carrying harness (2) by being positioned against the dorsal part (5) on an external wall of the cover.

7. The garment according to claim 1, wherein the abdominal parts (3, 4) comprise a set of pockets (310-313, 410-412) adapted to receive electronic equipment and/or munitions.

8. The garment according to claim 2, wherein at least one of the abdominal parts (3, 4) comprises a cover (31) to receive a protection pack (32) for the torso, the abdominal parts (3, 4) being suitable for covering the torso by overlapping.

* * * * *